US009006588B2

(12) United States Patent
Schewe

(10) Patent No.: US 9,006,588 B2
(45) Date of Patent: Apr. 14, 2015

(54) ELECTRIC PARTITION FEEDTHROUGH

(75) Inventor: Eckhard Schewe, Heilbronn (DE)

(73) Assignee: Amphenol-Tuchel Electronics GmbH (DE)

( * ) Notice: Subject to any disclaimer, the term of this patent is extended or adjusted under 35 U.S.C. 154(b) by 420 days.

(21) Appl. No.: 13/129,452

(22) PCT Filed: Nov. 24, 2009

(86) PCT No.: PCT/EP2009/008350

§ 371 (c)(1),
(2), (4) Date: Aug. 3, 2011

(87) PCT Pub. No.: WO2010/060591

PCT Pub. Date: Jun. 3, 2010

(65) Prior Publication Data

US 2011/0278059 A1 Nov. 17, 2011

(30) Foreign Application Priority Data

Nov. 27, 2008 (DE) ..... 10 2008 059 308

(51) Int. Cl.

| | |
|---|---|
| ***H01B 17/30*** | (2006.01) |
| ***H01R 13/52*** | (2006.01) |
| ***H01R 13/621*** | (2006.01) |
| ***H01R 13/74*** | (2006.01) |

(52) U.S. Cl.

CPC ..... *H01R 13/5202* (2013.01); *H01R 13/621* (2013.01); *H01R 13/746* (2013.01); *H01R 2201/26* (2013.01)

(58) Field of Classification Search

CPC . H01R 13/5202; H01R 13/746; H01R 13/621
USPC ..... 174/650
See application file for complete search history.

(56) References Cited

U.S. PATENT DOCUMENTS

| | | | | |
|---|---|---|---|---|
| 2,605,315 | A * | 7/1952 | Hargett | 439/275 |
| 3,643,207 | A * | 2/1972 | Cairns | 439/201 |
| 4,090,759 | A * | 5/1978 | Herrmann, Jr. | 439/281 |
| 5,857,865 | A * | 1/1999 | Shimirak et al. | 439/277 |
| 7,214,095 | B1 * | 5/2007 | Mathews | 439/578 |
| 2005/0176296 | A1 | 8/2005 | Montena | |
| 2008/0233791 | A1 * | 9/2008 | Hanks | 439/427 |

FOREIGN PATENT DOCUMENTS

| | | | |
|---|---|---|---|
| DE | 1465733 | A1 | 5/1969 |
| DE | 202006019971 | U1 | 8/2007 |
| EP | 1318570 | A1 | 6/2003 |
| FR | 2769136 | A1 | 4/1999 |

* cited by examiner

*Primary Examiner* — William H Mayo, III
*Assistant Examiner* — Hiram E Gonzalez
(74) *Attorney, Agent, or Firm* — Blank Rome LLP

(57) ABSTRACT

An electric partition feedthrough for mounting on a partition. The feedthrough includes a housing having a control cam integrally molded on the outside of the housing, a contact, and a sealing element. A movably fastened closure element is provided on the housing. The closure element is designed to move the housing and the control cam such that the sealing element is transferred from a pre-mounting position to a final mounting position.

14 Claims, 3 Drawing Sheets

ELECTRIC PARTITION FEEDTHROUGH

CROSS-REFERENCE TO RELATED APPLICATIONS

The present application claims the benefit of International Patent Application No. PCT/EP2009/008350, filed Nov. 24, 2009, which in turn claims priority to DE 10 2008 059 308.7filed Nov. 27, 2008, the entire disclosures are incorporated by reference herein.

BACKGROUND OF THE INVENTION

1. Field of the Invention

The invention relates to an electric partition feedthrough according to the preamble of claim 1.

The invention therefore relates to an electric partition feedthrough for producing a sealed connection, in particular electrical connection, between two sides of a partition with two flat sides lying opposite one another.

2. Description of the Related Art

In the prior art there has regularly been the problem that feeding through an electric line through a wall, that is to say a partition, when distributing electric energy is problematic. In particular, cases in which access for mounting can easily be ensured from only one side are problematic. If, moreover, a pluggable, that is to say releasable, connection (electrical connection) is necessary, particular configurations of such electric partition feedthroughs are necessary.

In the prior art, for example in GM 20 2006 019 971.3, an electric partition feedthrough for motor vehicles is disclosed. In said document, an electric plug-type connection is arranged between a cylindrical high-current contact socket (RADSOK socket) and a high-current contact pin between which a partition with two flat sides lying opposite one another is arranged, and which the high-current contact socket or the high-current contact pin can be held in an opening within the partition and projects beyond said partition on both flat sides, and that the high-current contact socket or the high-current contact pin has a plug-type rotary closure element which can be fed at least partially through the opening and which is securely connected to the high-current contact socket or the high-current contact pin and forms the latter on the partition in a securing fashion.

As a result, an electrical connection can be produced through the separating panel, for example between the engine compartment and the passenger compartment of the vehicle.

However, such a partition feedthrough requires a defined geometric shape and therefore a special tool for the flange which is integrally formed onto the plug-type connector to be capable of being mounted with a through-plugging mounting method and of being locked to the partition after rotation of the plug-type connection.

The present invention is therefore based on the object of proposing an improved partition feedthrough for a conventional, that is to say essentially round, opening, in a partition, which is easier to mount.

A significant disadvantage of the embodiment of a partition feedthrough which was previously specified in the prior art is that the opening in the partition, that is to say the opening diameter, must generally be made larger or with such a contour that parts which later serve to lock the plug-type connection or partition feedthrough can be plugged through the opening. In brief, the partition feedthroughs are generally made larger in their outer contour than the size of the through-opening in the partition which is formed for that purpose.

A further object of the present invention is therefore to make available an electric partition feedthrough in such a form that a minimum opening can be made in the partition.

This object is achieved with the features of claim 1.

Advantageous developments of the invention are specified in the subclaims.

SUMMARY OF THE INVENTION

The invention is therefore based on the idea of leading through the electric partition feedthrough through an essentially circular opening in a partition, in particular in any desired flat separating panel, and of securing said partition feedthrough in a seal-forming fashion to the partition by means of a closure element, for example a screw connection.

In one embodiment of the invention, there is advantageously provision that a housing of the partition feedthrough can be plugged through the opening in the partition by means of a simple plugging mounting method and can be secured to the partition by means of a closure element by means of a rotational movement.

For this purpose, the invention provides a sealing element on the housing of the partition feedthrough, which sealing element is attached to the housing of the partition feedthrough in a movable fashion such that said housing can be placed in a seal-forming state by means of mechanical deformation.

In conventional sealing elements which are present in the prior art, the seal is generally formed by deforming and pressing the sealing element itself between two surfaces.

However, the present invention is based on the idea of transferring a sealing element into a desired seal-forming position along a control cam on the housing.

In this respect, three positions of the partition feedthrough according to the invention are differentiated.

The first position defines the premounting position of the electric partition feedthrough with its housing and its sealing element which is located in the premounting position.

The second position corresponds in principle to the first position and is produced by virtue of the fact that the electric partition feedthrough is inserted with its housing into a partition opening and a closure element is fitted onto the housing. In this position, also referred to as the premounting position, the sealing element continues to be in its non-deflected position. Only by activating the closure element can the housing be moved with respect to the closure element in such a way that the control cam which is present on the housing activates the sealing element in such a way that the latter moves and is transferred into a final mounting position in which the sealing element comes to bear both on the two housing wall outer sides and on the inner face of the partition opening side (inner face of the partition opening).

The idea of the present invention is therefore supported on the principle of a splaying movement of an essentially cylindrical sealing element from a position in which, after introduction into the premounting position, it comes to bear with a section against a side, that is to say the outer side, of the partition feedthrough and against the inner face of the partition opening and can then be changed into a seal-forming end mounting state by means of the previously mentioned closure element, advantageously by the formation or deformation or splaying along the control cam on the housing in order then to come to bear at the end, when the final mounting position is reached, against the two partition sides and the inner face of the partition opening, and as a result bring about the sealing function and the mechanical strength of the electric partition feedthrough with the partition.

The closure element can advantageously be rotated as a screw element on a thread integrally formed on the housing, in such a way that the housing moves continuously when the screw element is activated, and at the same time the sealing element is continuously transferred into the correct final mounting position and sealing position.

In one advantageous embodiment of the invention, the sealing element is embodied as an essentially cylindrical sealing element with an annular sealing element section at one end, which sealing element section is made larger in its overall extent and therefore in its overall diameter than the diameter of the partition opening, and as a result can be brought to bear against one side of the partition opening.

The second region of the sealing element, like the second sealing element section referred to below, is advantageously embodied as a cylindrical sealing element section bearing against a housing which is advantageously in the form of a cylinder.

The outer dimension of the second sealing element section are selected here in such a way that an objective of the invention can be achieved, specifically the plugging-through mounting method through a partition opening which has essentially the same diameter as the outer diameter in the region of the second sealing element section.

In brief, the sealing element is embodied with one section larger than the diameter of the partition leadthrough and one section which is essentially the same as or at minimum smaller than the opening in the partition.

In one alternative embodiment of the invention, the outer diameter of the sealing element can also be embodied in such a way that in the previously described premounting position it is not completely in contact with the inner face of the partition opening but rather there is a minimum gap between the inner face of the partition opening and the outer contour of the sealing element in the premounted state.

When the sealing element is transferred from its premounting position into its final mounting position, the control cam can in this context be embodied on the housing in such a way that the sealing element does not come into contact with the inner face 62 of the partition opening until the final mounting position is reached.

A particularly advantageous embodiment is achieved by virtue of the fact that an essentially curved control cam is provided on a housing shoulder on the housing, on which housing shoulder, when the closure element is screwed to the housing, the sealing element can be deflected consistently with a cam section which is of complementary design at the end of the sealing element, and can be transferred into its final mounting position.

Two angular plug-type connectors 70, 71 can then be used to make an electrical connection to the contact introduced into the electric partition feedthrough, by plugging on said contact.

The housing is advantageously embodied in such a way that partially cylindrical housing projections, preferably semi-cylindrical housing projections, project beyond the contact element arranged in the housing. This ensures that angular plug-type connectors, preferably 90° angular plug-type connectors, can be provided on the partition and as a result space-saving mounting is brought about.

BRIEF DESCRIPTION OF THE DRAWINGS

Further advantages and expedient embodiments can be found in the further claims, the description of the figures and the drawings, in which:

DETAILED DESCRIPTION OF THE PREFERRED EMBODIMENTS

Figure 1:
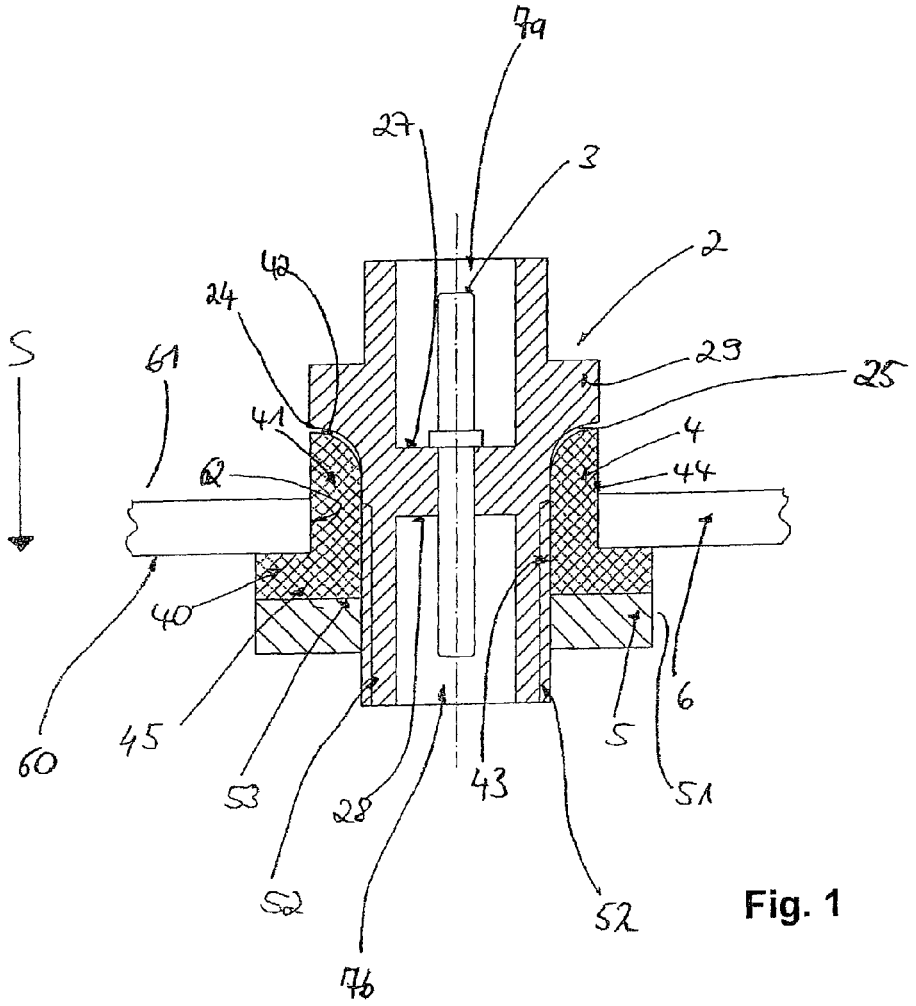
FIG. 1 shows a section through a first exemplary embodiment of a partition feedthrough according to the invention.

FIG. 1 shows a first exemplary embodiment of an electric partition feedthrough 1 in a premounted state.

The electric partition feedthrough 1 is composed essentially of a housing 2, a contact 3 which is arranged in the housing 2, a sealing element 4 and a closure element 5.

Figure 2:
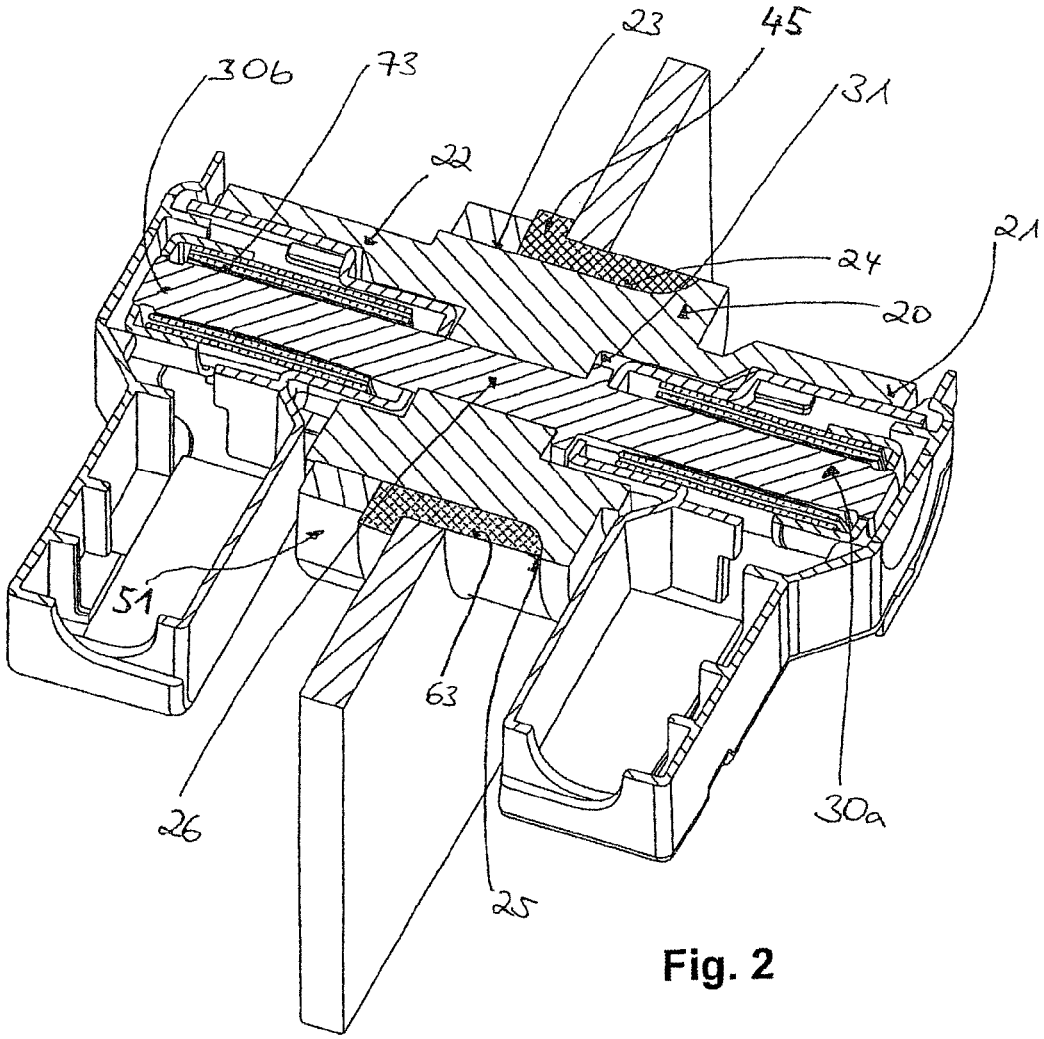
FIG. 2 shows a second exemplary embodiment in a semi-sectional illustration of a partition feedthrough according to the invention with plugged-on angular plug-type connectors in the premounted state.

FIG. 1 and FIG. 2 show the state in which the sealing element 4 is in its premounting position. The closure element 5 is embodied here as a screw element 50 which can be screwed onto the thread 52 which runs around the outside of the housing 2. When the closure element 5 is screwed, the housing 2 is moved in the plugging direction S and displaced.

The elements of the partition feedthrough are described individually below.

The Sealing Element 4

The sealing element 4 is formed from a first sealing element section 40 and a second sealing element section 41 which extends essentially orthogonally with respect thereto. The sealing element section 40 is, as is shown in FIG. 1, formed as a sealing flange 45 which is embodied essentially in an annular shape. The sealing flange 45, which constitutes the first sealing element section 40, adjoins in a positively fitting fashion a second sealing element section 41 which extends essentially in a linear fashion. This second sealing element section 41 has an outer diameter such that it can be plugged in through a partition opening with a virtually identical outer diameter.

The second sealing element section 41 is to be seen a sealing element section which is embodied essentially as a cylindrical casing. This cylindrical sealing element section 41 comes to bear with the outside of the housing 2. At the free end of the second sealing element section 41, the sealing element 4 has a control cam section 42 as an essentially curved section. In this respect, the second sealing element section 41 has a sealing face 43 on the housing wall side and against a partition-side sealing face 44. Wherein, in the premounted state, the partition-side sealing face 44 comes to bear, as shown in FIG. 1, against a first partition side 60 and against the inner face 62 of the partition opening. While, as shown in FIG. 3, the sealing element 4 comes to bear the final mounting position with its partition-side sealing face 44 against the first and second partition sides 60, 61 and against the inner face 62 of the partition opening.

Figure 3:
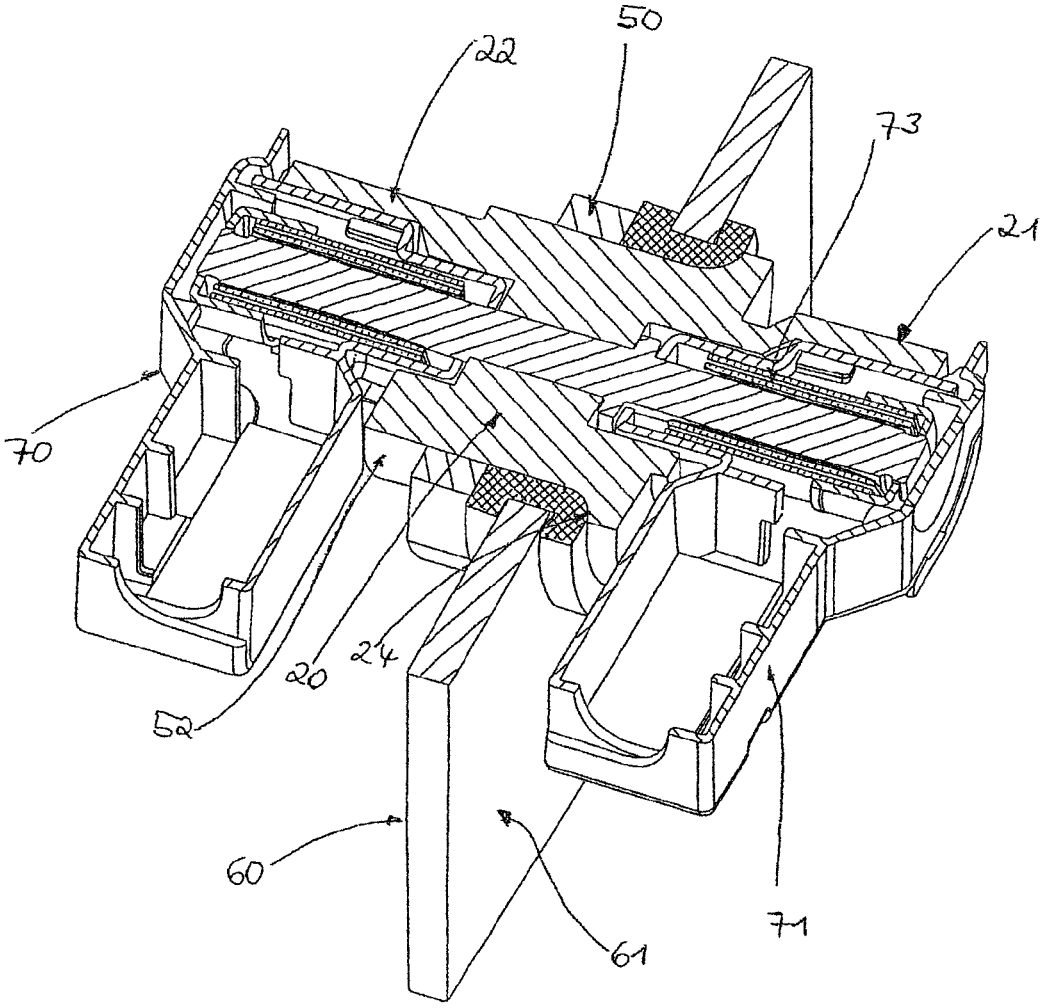
FIG. 3 shows a similar view to FIG. 2, but in the final mounted state.

The sealing element is transferred, as shown in FIG. 1 and FIG. 2, from the premounting position into the final mounting position shown in FIG. 3 by simple rotation of the closure element 5 on the housing 2.

The Housing 2

The housing 2 is an insulating element which is essentially extended longitudinally in the plugging direction by virtue of the fact that a contact element 3 is arranged. The housing 2 has two housing openings 7*a*, 7*b* into which the contact element 3 extends. Two housing projections 21, 22 are located on the housing center part 20 and, as shown in FIG. 2 and FIG. 3, are advantageously embodied as semi-cylindrical housing projections. As a result, angular plug-type connectors can be connected to the electric partition feedthrough. A peripheral shoulder 29, which is continuous with a rim 25, is integrally formed onto the housing 2. In this context, the rim 25 forms a control cam 24 for the sealing element 4. As can be clearly seen in FIG. 1, the control cam 24 is embodied as an outwardly curved housing wall section. A thread 52 is advantageously arranged on one side of the housing 2 for the closure element 5.

The Closure Element 5

The closure element 5 serves to transfer the housing 2 and therefore the sealing element 4 from the premounting position, as shown in FIG. 1 and FIG. 2, into the final mounting position, as shown in FIG. 3. In a simple embodiment, the closure element 5 is embodied as a screw element 50 with key faces 51. A tool can be fitted to the key faces 51 in order to screw the screw element 50 correctly to the thread 52 of the housing 2, as a result of which the housing 2 is moved in the plugging direction S, that is to say with its shoulders 29 in the plugging direction S, specifically in the direction of the second partition side 61. As a result, the second sealing element section 41 experiences a controlled forced movement in the outward direction along the control cam 24 and in the process is transferred, by means of its control cam section 42, into the position shown in FIG. 3. This position ensures positively fitting and frictionally fitting sealing of the partition feedthrough by virtue of the fact that the sealing element 4 seals in a positively fitting fashion on both partition sides 60, 61 and on the inner side of the partition opening 62.

In alternative embodiments, the closure element can also be embodied as a bayonet means, latching means or closure means with an equivalent effect. For example, a plurality of latching noses could be arranged running around the outside of the housing, with the result that the closure element 5 can be latched incrementally against the housing 2 as it holds the housing 2 tight, specifically to such an extent that the desired deformation of the sealing element 4 along the control cam 24 has taken place.

The invention also comprises alternative, equivalently acting embodiments, but these are not described individually.

An angular plug-type connector 70, 71 with a cylindrical socket contact 73 (RADSOK contacts) can advantageously be introduced into the electric partition feedthrough 1, as a result of which overall a high-current partition feedthrough is produced.

LIST OF REFERENCE NUMBERS

Electric Partition Feedthrough

1 Electric partition feedthrough
2 Housing
3 Contact element
4 Sealing element
5 Closure element
6 Partition
7*a*, 7*b* Housing openings
20 Housing center part
21 First housing projection
22 Second housing projection
23 Housing wall section
24 Control cam
25 Rim
26 Contact opening
27, 28 First and second housing walls
29 Shoulder
30*a*, 30*b* Contact ends
40 First sealing element section
41 Second sealing element section
42 Control cam section
43 Housing-wall-side sealing face
44 Partition-side sealing face
45 Sealing flange
50 Screw element
51 Key faces
52 Thread
53 Bearing face
60 First partition side
61 Second partition side
62 Inner face of partition opening
70 First angular plug-type connector
71 Second angular plug-type connector
73 Cylindrical socket contacts

What is claimed is:

1. An electric partition feedthrough for mounting on a partition, comprising:

a housing having a control cam integrally molded on the outside of the housing, the control cam having a curved section that curves outwardly from a longitudinally extending section of the housing;

a contact; and a sealing element having a first sealing element section, and a second sealing element section that has an outer diameter such that it can be plugged in through a partition opening with a virtually identical diameter, wherein a movably fastened closure element is provided on the housing, wherein the control cam is embodied on the housing in such a way that the housing can be moved with its control cam relative to and by means of the closure element in such a way that the sealing element can he transferred consistently from a premounting position into a final mounting position deviating in the position thereof from the former.

2. The electric partition feedthrough as claimed in claim 1, wherein the sealing element has a sealing flange for bearing against one of the partition sides.

3. The electric partition feedthrough as claimed in claim 2, wherein in the premounted state the sealing element comes to bear against at least one side of the partition sides, and in the final mounting state it can be moved against both partition outer sides.

4. The electric partition feedthrough as claimed in claim 1, wherein the sealing element comes to bear against a closure element in a planar fashion by means of a bearing face.

5. The electric partition feedthrough as claimed in claim 4, wherein the sealing element is embodied as an essentially cylindrical sealing element with the first and the second sealing element sections embodied essentially orthogonally with respect to one another.

6. The electric partition feedthrough as claimed in claim 5, wherein the first sealing element section is formed by the sealing flange and is arranged so as to come to bear in a seal-forming fashion between the closure element and one of the partition sides.

7. The electric partition feedthrough as claimed in claim 5, wherein the second sealing element section is embodied in one piece with the sealing flange.

8. The electric partition feedthrough as claimed in claim 7, wherein the sealing element is arranged on the outside of the housing in such a way that the sealing element extends with its second sealing element section along the direction of extent of the housing.

9. The electric partition feedthrough as claimed in claim 7, wherein the second sealing element section has a control cam at its free end.

10. The electric partition feedthrough as claimed in claim 7, wherein the closure element is embodied in such a way that it can transfer the housing from its premounting position into its final mounting position by activation, preferably by rotation, and in the process the free end of the sealing element section is moved with its control cam section along the control cam, and in the process its position is changed in such a way that it can be brought to bear at least partially in a seal-forming fashion with a partition side in the direction of the side lying opposite the sealing flange.

11. The electric partition feedthrough as claimed in claim 4, wherein the closure element is a screw element.

12. The electric partition feedthrough as claimed in claim 11, wherein an outer thread for the screw element is provided on the housing.

13. The electric partition feedthrough as claimed in claim 1, wherein a shoulder, which forms the control cam as a curved housing wall section, is provided on the outside of the housing.

14. The electric partition feedthrough as claimed in claim 1, wherein the shoulder is embodied with the control cam as a housing contour which runs completely around the outside of the housing.

* * * * *